US008627891B2

(12) United States Patent
Omvik

(10) Patent No.: US 8,627,891 B2
(45) Date of Patent: Jan. 14, 2014

(54) MANIFOLD STRUCTURE HAVING ADJUSTABLE BRACKETS

(75) Inventor: Sigvard Omvik, Moss (NO)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 12/992,155

(22) PCT Filed: May 12, 2009

(86) PCT No.: PCT/NO2009/000179
§ 371 (c)(1),
(2), (4) Date: Nov. 11, 2010

(87) PCT Pub. No.: WO2009/139639
PCT Pub. Date: Nov. 19, 2009

(65) Prior Publication Data

US 2011/0061871 A1 Mar. 17, 2011

(30) Foreign Application Priority Data

May 15, 2008 (NO) ..... 20082232

(51) Int. Cl.
*E21B 7/12* (2006.01)

(52) U.S. Cl.
USPC ..... 166/366; 166/338; 166/340; 166/351; 166/360

(58) Field of Classification Search
USPC ..... 166/338, 340–345, 351, 360; 405/222.4, 169, 154.1, 170, 174, 405/184.4, 184.5
See application file for complete search history.

(56) References Cited

U.S. PATENT DOCUMENTS

| | | | | | |
|---|---|---|---|---|---|
| 2,714,789 | A | * | 8/1955 | Perks, Sr. | 451/347 |
| 3,633,667 | A | * | 1/1972 | Falkner, Jr. | 166/366 |
| 3,690,112 | A | * | 9/1972 | Pattison et al. | 405/169 |
| 3,777,812 | A | * | 12/1973 | Burkhardt et al. | 166/338 |
| 3,877,520 | A | * | 4/1975 | Putnam | 166/366 |
| 4,013,178 | A | * | 3/1977 | Brown et al. | 414/22.63 |
| 4,028,903 | A | | 6/1977 | Dietrich | |
| 4,075,862 | A | * | 2/1978 | Ames | 405/169 |
| 4,120,362 | A | * | 10/1978 | Chateau et al. | 166/339 |
| 4,175,620 | A | * | 11/1979 | Nolan et al. | 166/343 |
| 4,192,383 | A | * | 3/1980 | Kirkland et al. | 166/341 |
| 4,202,653 | A | * | 5/1980 | Moller | 414/22.57 |

(Continued)

FOREIGN PATENT DOCUMENTS

| | | |
|---|---|---|
| NO | 165.653 | 5/1988 |
| NO | 304.448 | 9/1998 |
| WO | WO-98/39590 A1 | 9/1998 |

OTHER PUBLICATIONS

Sundnes, Asbjørn, "International Search Report", for PCT/NO2009/000179 as mailed Jul. 10, 2009, 3 pages.

*Primary Examiner* — Matthew Buck
*Assistant Examiner* — Aaron Lembo
(74) *Attorney, Agent, or Firm* — Winstead PC

(57) ABSTRACT

The invention relates to a manifold structure that includes a frame construction (1), a number of pipes (2), a pipe bend and possible valves, deployed in a pipe system having a number of pipe terminations projecting from the frame construction. The frame construction (1) is designed with a number of support brackets (5) for respective coupling parts associated with said pipe terminations. Each support bracket (5) is made as a separate, standardized unit that includes several securing means for releasable assembly to the frame construction, where each securing means is arranged for defined adjustability in height and lateral direction for adaption to a preinstalled pipe termination.

16 Claims, 4 Drawing Sheets

(56) References Cited

U.S. PATENT DOCUMENTS

Figure 1:
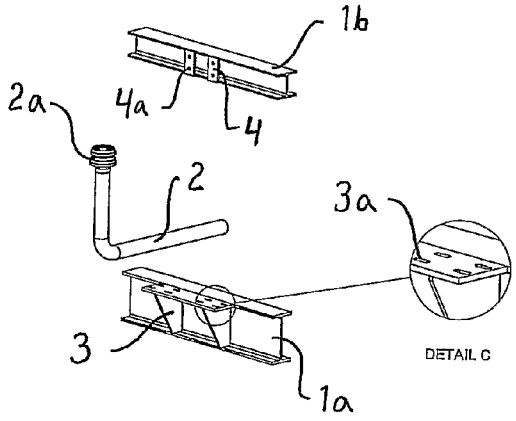

| | | | | | |
|---|---|---|---|---|---|
| 4,208,004 | A | * | 6/1980 | Yago | 228/173.7 |
| 4,438,817 | A | * | 3/1984 | Pokladnik et al. | 166/341 |
| 4,442,900 | A | * | 4/1984 | Padilla et al. | 166/342 |
| 4,457,378 | A | * | 7/1984 | Watkins | 166/347 |
| 4,462,733 | A | * | 7/1984 | Langowski et al. | 414/22.71 |
| 4,472,080 | A | * | 9/1984 | Lawson | 405/169 |
| 4,472,081 | A | * | 9/1984 | Lawson | 405/169 |
| 4,477,205 | A | * | 10/1984 | Morrill et al. | 405/169 |
| 4,518,042 | A | * | 5/1985 | Miller | 166/347 |
| 4,580,636 | A | * | 4/1986 | Johnson et al. | 166/343 |
| 4,661,017 | A | * | 4/1987 | Wood et al. | 405/169 |
| 4,686,873 | A | * | 8/1987 | Lang et al. | 81/57.35 |
| 4,784,523 | A | * | 11/1988 | Louis et al. | 405/169 |
| 4,789,271 | A | * | 12/1988 | Sullaway et al. | 405/225 |
| 4,842,075 | A | * | 6/1989 | Kalvenes et al. | 166/341 |
| 4,878,694 | A | * | 11/1989 | Castel | 285/24 |
| 5,025,865 | A | * | 6/1991 | Caldwell et al. | 166/366 |
| 5,040,607 | A | * | 8/1991 | Cordeiro et al. | 166/366 |
| 5,163,782 | A | * | 11/1992 | Paulo | 405/169 |
| 5,192,167 | A | * | 3/1993 | da Silva et al. | 405/195.1 |
| 5,244,312 | A | * | 9/1993 | Wybro et al. | 405/204 |
| 5,255,745 | A | * | 10/1993 | Czyrek | 166/347 |
| 5,310,006 | A | * | 5/1994 | Freitas et al. | 166/339 |
| 5,341,884 | A | * | 8/1994 | Silva | 166/347 |
| 5,526,882 | A | * | 6/1996 | Parks et al. | 166/339 |
| 5,702,205 | A | * | 12/1997 | Mahone et al. | 405/169 |
| 6,003,604 | A | * | 12/1999 | Wilkins | 166/366 |
| 6,312,193 | B1 | * | 11/2001 | Witting et al. | 405/169 |
| 6,340,057 | B1 | * | 1/2002 | Dantas | 166/337 |
| 6,494,267 | B2 | * | 12/2002 | Allen | 166/347 |
| 6,516,861 | B2 | * | 2/2003 | Allen | 166/351 |
| 6,835,025 | B1 | * | 12/2004 | Beard et al. | 405/184.4 |
| 7,086,807 | B2 | * | 8/2006 | Mackinnon | 405/170 |
| 7,112,009 | B2 | * | 9/2006 | Mackinnon | 405/173 |
| 7,281,880 | B2 | * | 10/2007 | Tucker et al. | 405/154.1 |
| 7,866,398 | B2 | * | 1/2011 | Barratt et al. | 166/341 |
| 7,967,541 | B2 | * | 6/2011 | Stroshein et al. | 414/22.65 |
| 2002/0062965 | A1 | * | 5/2002 | Allen | 166/368 |
| 2006/0231266 | A1 | * | 10/2006 | Rodrigues et al. | 166/365 |
| 2008/0112762 | A1 | * | 5/2008 | van Zandwijk et al. | 405/166 |
| 2011/0150576 | A1 | * | 6/2011 | Alliot | 405/169 |

* cited by examiner

MANIFOLD STRUCTURE HAVING ADJUSTABLE BRACKETS

The present invention relates to a manifold structure including a frame construction, a number of pipes, pipe bends and possible valves, which are deployed in a pipe system having a number of pipe terminations projecting from the frame construction, which frame construction is provided with a number of support brackets for respective connector parts associated with said pipe terminations.

The invention also relates to a method for the manufacture of a manifold structure of the kind stated above.

Such manifold structures are designed to be placed on the sea bed and are to be connected to one or more Christmas trees for the production of oil and/or gas. The interconnecting operation takes place in that jumpers, or lines, are lowered from the surface toward connecting points on the manifold structure and the Christmas trees. The manifold structure is often constructed by a number of girders and braces suitably arranged in a more or less open frame construction which in turn can be set on a base located on the sea bed, for example a suction anchor or mud mat. The piping includes a number of headers, branch pipes, bends and valves.

It has been a problem with the production tolerances during the manufacture of such manifold structures. This needs to been seen in conjunction with the huge dimensions involved. The structures are frequently several tenths of meters long and support correspondingly long pipes having large dimensions, often several decimetres in diameter. The pipes and bends with their angles, are manufactured according to dimensioned drawings. The same apply for the body of the frame construction and associated support brackets. Generally 10-12, or more, support brackets are present per manifold structure. The support brackets are to form support and mount for respective pipe ends with their terminations. All factors above result in that a problem with the installation may occur if the components do not fit perfectly to each other.

Each pipe of the piping end in a pipe termination in the form of a connector flange which together with a connector porch (guide cone) forms a connector part which constitute the male part of a connector assembly. The male part is in one way or another secured to a support bracket on the frame construction. Until today each support bracket has been fixedly welded to the frame construction as if it was an integrated part thereof. This has resulted in problems if the pipes are not precisely manufactured with regard to pipe lengths and bend angles. By presumption, these parts are to fit precisely to the support brackets. When this has not been the case, it has been necessary to cut loose the bracket and have it displaced such that the bracket fits in with the connector flange, and then weld the bracket once again to the frame construction.

In addition, the support brackets have often been facing into the manifold structure, though not always. This has resulted in problems with the access during later interconnecting operations.

One object with the present invention has been to reduce the requirements to the tolerances in the manufacture of the main pipes. Thus it will be possible to cut down the use of time and reduce the manufacturing costs. In addition, deformations applied to the pipes due to manufacturing tolerances will not take place. At the same time, they will be easier to install without a need to use forces in order to force the pipes in place.

Another object has been to be able to perform parallel production of the frame construction and the components, for example the support brackets and the pipes. Thus a shorter manufacturing time during module construction is obtained.

Still another object has been to "standardize" components to be used on the frame construction such that these can be constructed and prepared independently of when the frame construction is constructed.

Still another object has been to improve the access to internal manifold structure during manufacturing thereof, such as good access during installation and assembly of pipes and bends.

The above stated objects are achieved according to the present invention in that a manifold structure of the introductory said kind is provided, which is distinguished in that each support bracket is made as a separate, standardized unit that includes several securing means for releasable assembly to the frame construction, which securing means are designed for defined adjustability in height and lateral direction for adaption to a preinstalled pipe termination.

It is to be understood that it is of material significance that the pipe up to the male part continuously needs to remain unloaded after the male part is fixedly secured—ergo no prevailing constraining forces subsequent to final assembly.

Preferably the securing means can include bolts/bolt connections. Bolts/bolt connections can extend through oblong apertures in order to obtain said adjustability.

According to the present invention a support bracket designed for installation on a manifold structure as stated above is also provided, where the support bracket is designed to support a connector part which retains a pipe end having a connector flange, which in particular is distinguished in that the support bracket includes several securing means for releasable installation to the frame construction, which securing means are designed for defined adjustability in height and lateral direction for adaption to a preinstalled pipe spool having said connector flange.

In accordance with the present invention a method of the introductory said kind is also provided, which is distinguished in that the piping firstly is installed in place within the frame construction and having pipe terminations projecting outwards from the frame construction and directed upwards, that a support bracket is placed at respective pipe terminations and coarse adjusted relative to the pipe terminations, that a connector porch is installed over respective connector flanges, that each connector porch is fixedly bolted to an associated connector flange and then welded to an associated support bracket, said support bracket subsequently being fine adjusted and finally fixed to the frame construction.

Figure 2:
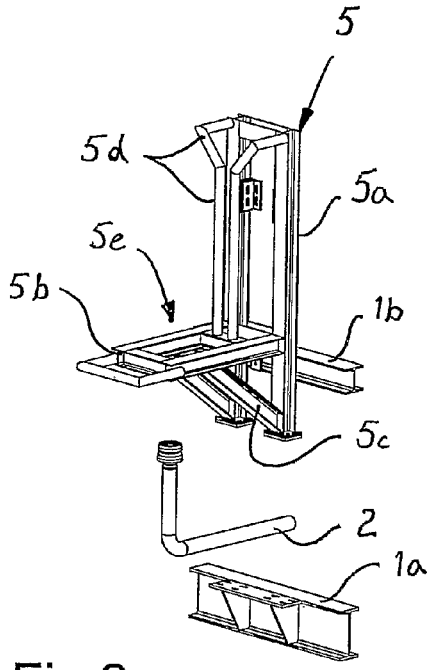
Figure 3:
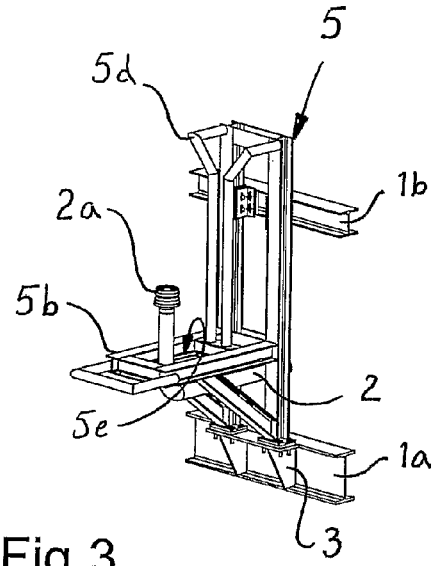
Figure 4:
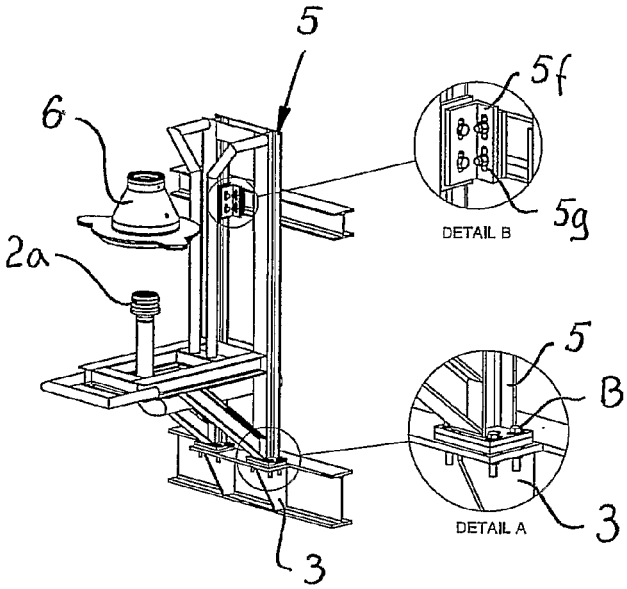
Figure 5:
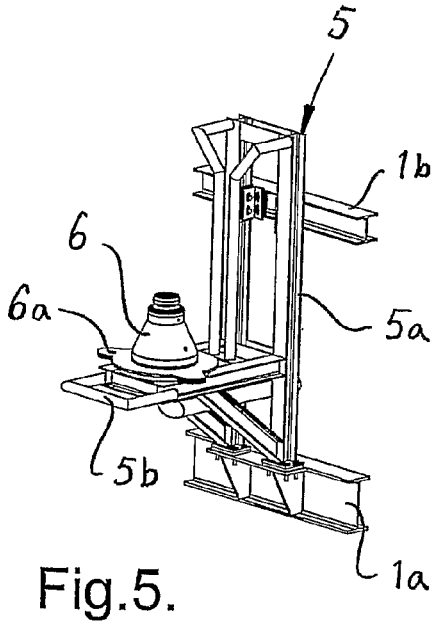
Figure 6:
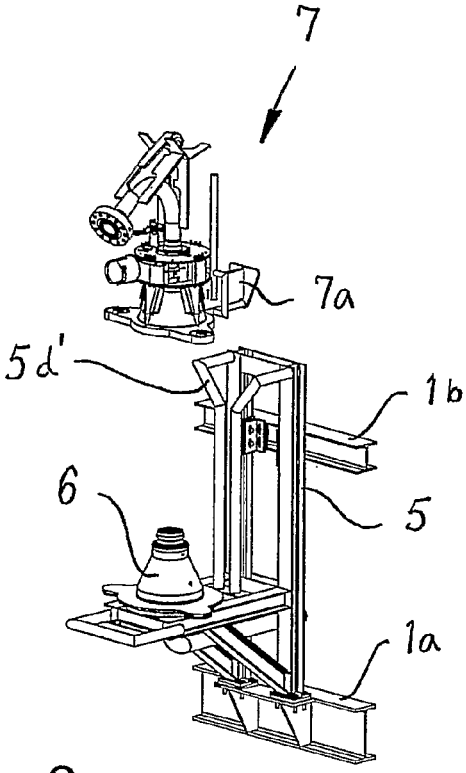
Figure 7:
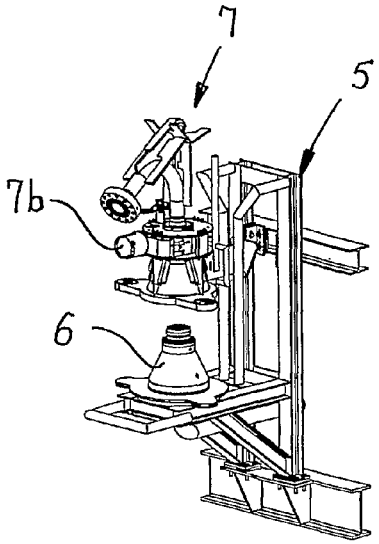
Figure 8:
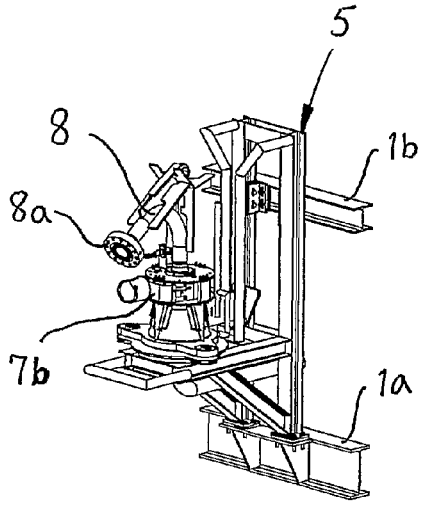
Figure 9:
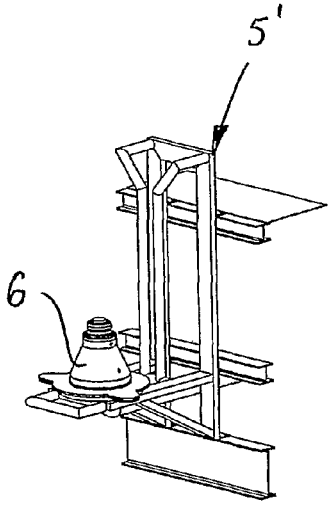
Figure 10:
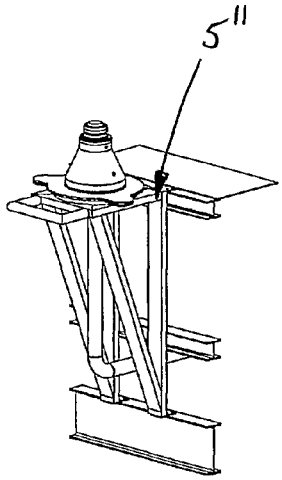
Figure 11:
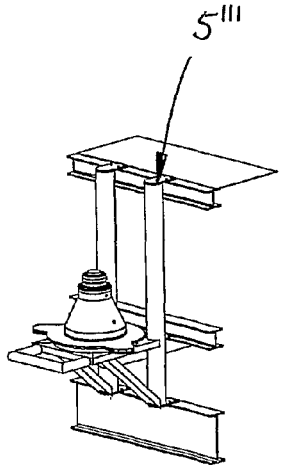

Other and further objects, features and advantages will appear from the following description of preferred embodiments of the invention, which is given for the purpose of description, and given in context with the appended drawings where:

FIG. 1 shows in perspective view a cut out of a top frame and bottom frame of the frame construction of a manifold structure, including a detailed view C, FIG. 2 shows in perspective view a support bracket which is lowered for installation on the frame construction of the manifold structure according to the invention, FIG. 3 shows in perspective view the support bracket completely landed on the frame construction of the manifold structure according to the invention, FIG. 4 shows in perspective view a connector porch which is about to be landed on the support bracket of the frame construction, including two detailed views A and B, FIG. 5 shows in perspective view the connector porch completely landed on the support bracket of the frame construction of the manifold structure according to the invention, FIG. 6 shows in perspective view installation of a VCM on the connector porch on the support bracket on the frame construction of the manifold structure according to the invention, FIG. 7 shows in perspective view when the VCM enters the support bracket on the frame construction, FIG. 8 shows in perspective view the VCM completely landed on the support bracket on the frame construction, FIG. 9-11 show a variety of alternative embodiments of support brackets according to the invention.

Figure 12:
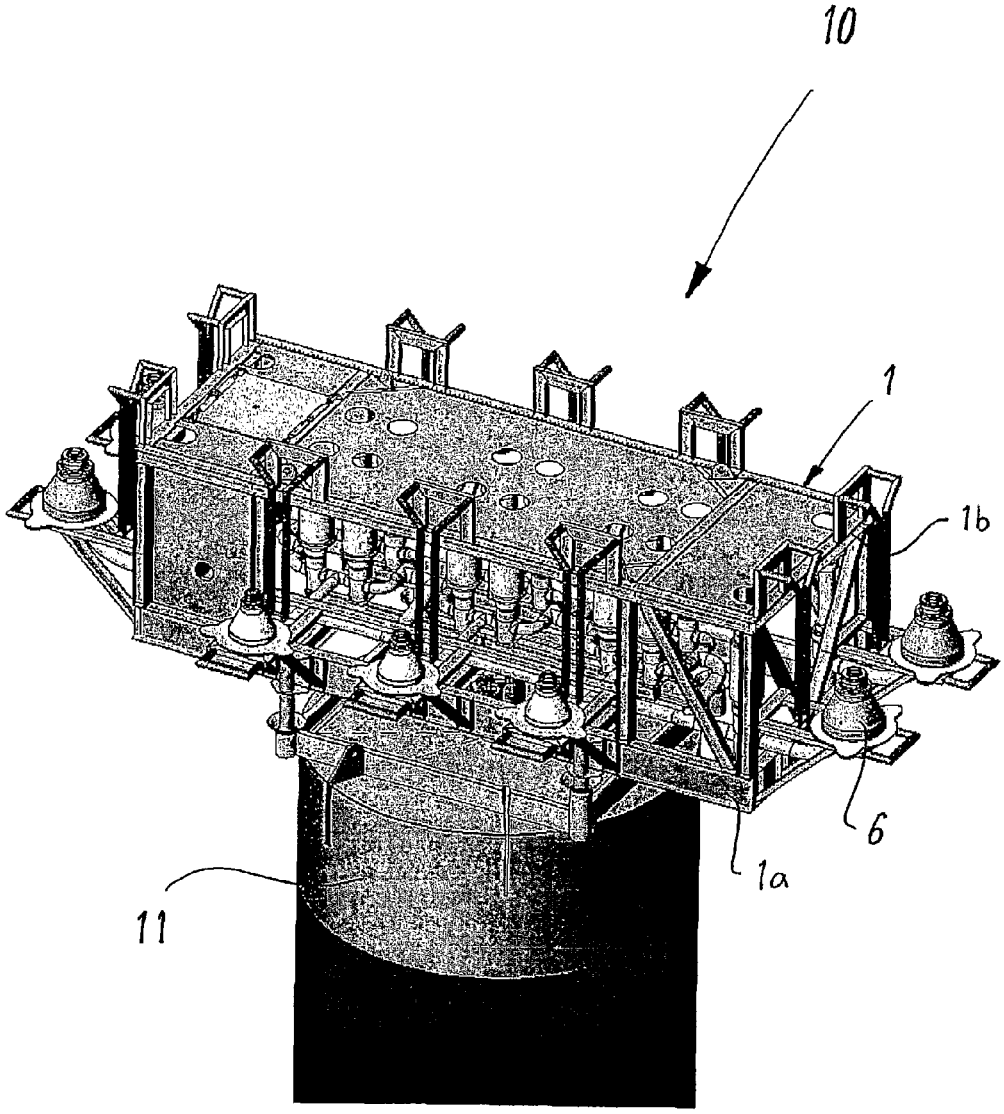

FIG. 12 shows a typical manifold structure with support brackets according to the invention.

A typical and complete manifold structure 10 is illustrated in FIG. 12 and can be conferred to as the FIGS. 1-11 are described. This is to ease the understanding of the invention and be able to recognize the interrelation where the individual parts and components are to be placed within the manifold structure and in relation to each other. The shown manifold structure 10 is fixed to a suction anchor 11 which in turn is placed on the sea bed.

Reference is firstly made to FIG. 1 which shows a partial view of a manifold structure, more precisely a bottom part 1*a* and a top part 1*b* of the frame construction 1 of the manifold structure 10. Then frame construction 1 is of substantial dimensions, often several tenths of meters long. An angled pipe 2, or a bend, having a connector flange 2*a* is illustrated as located in the frame construction 1. Further, the bottom part 1*a* has a bracket structure 3 with oblong apertures 3*a* designed for later adjustable installation of components on the bracket structure 3. The top part 1*b* has a corresponding support structure 4 having apertures 4*a* designed for later installation of said components on the support structure 4.

FIG. 2 shows a support bracket 5 which is about to be landed on the frame construction 1. The support bracket 5 has a substantially vertically extending back structure 5*a*, one substantially horizontally extending support structure 5*b*, inclined braces 5*c* and a guiding structure 5*d*. Moreover the support structure 5*b* has a central aperture 5*e* for receipt of the bend 2.

FIG. 3 shows the support bracket 5 landed on the bracket structure 3 and rests thereon. The bend 2 fits through the aperture 5*e* in the support structure 5*b* and in turn, the connector flange 2*a* extends upwards from the plane of the support structure 5*b* and stands ready to receive a mating component.

FIG. 4 shows such a component in the form of a connector porch 6 (guide cone) which is to be lowered down over the connector flange 2*a*. Further, a detailed view A in enlarged scale is shown that illustrates the lower mount between the support bracket 5 and the support structure 3 on the bottom part 1*a*. A number of bolts B are used to secure the parts together. Oblong recesses in the parts enable the parts to be adjusted in respect of each other in the horizontal plane.

The detailed view B in FIG. 4 shows an upper securing means 5*f* on the back structure 5*a* in enlarged scale. The securing means 5*f* has oblong apertures 5*g* to be able to make height adjustment. If height adjustment is necessary, shims or spacers can be installed between respective flange parts on the support bracket 5 and the bracket structure 3, i.e. on that spot depicted in detailed view A in FIG. 4.

FIG. 5 shows the connector porch 6 completely landed onto the support structure 5*b*. The connector porch 6 has a bottom plate 6*a* which provides some freedom of motion in the horizontal plane to obtain correct position in respect of the connector flange 2*a*. The bottom plate 6*a* rests against the top surface of the support structure 5*b*.

FIG. 6 shows the first step in the finishing phase during installation of a vertical connector module 7 (VCM) onto the connector porch 6 which in turn is arranged on the support bracket 5 on the frame construction 1. The connector module 7 is landed from above and positioned such that the female part stands right above the connector porch 6. The connector porch 6 thus constitutes the male part. The connector module 7 has guiding means 7*a* which are design for cooperation with the guide structure 5*d* which is arranged on the back structure 5*a* of the support bracket 5. During the lowering operation the guiding means 7*a* guides the connector module 7 against the connector porch 6 by means of the guiding structure 5*d*. In the upper part of the guiding means 5*d*, inclined faces 5*d*' are provided to ease the introduction of the guiding means 7*a* into the guiding structure 5*a*.

FIG. 7 shows the next step of the finishing phase. The connector module 7 has engaged the guiding structure 5*d* via the guiding means 7*a* and is guided further into place toward the connector porch 6 on the support bracket 5. The connector module 7 includes a clamp connector 7*b* which makes up the final connection between the flanges.

FIG. 8 shows the finished installation of the connector module 7 on the connector porch 6 on the support bracket 5 on the frame construction 1. The connector module 7 includes a pipe bend 8 having a connector flange 8*a* which is used for later connection of a pipe line which is tied in toward this flange 8*a*.

FIGS. 9 to 11 show three variants 5'; 5''; 5''' among many possible embodiments of a support bracket according to the present invention.

The way in which the entire manifold structure is manufactured will now be described with reference to FIGS. 1-8. We assume that a per se traditional frame construction already has been manufactured and prepared for further construction, installation and assembly.

Firstly the piping (pipe system) is installed in place in the frame construction. All external connecting points in the form of pipe terminations project outwards from the body of the frame construction. The pipe terminations are further such designed that they are pointing upwards. Subsequently each bracket is placed over respective pipe terminations. Each bracket is coarse adjusted relative to the associated pipe termination.

Then a connector porch is placed over respective connector flange. Each connector porch is in turn bolted in place on corresponding connector flange. Then the connector porch is welded to its associated support bracket. Finally each bracket is fine adjusted and eventually fixed by means of bolts and nuts to the frame construction.

Thus, exactly this that the pipes are installed totally without stresses or loads is achieved.

The invention claimed is:

1. A method to manufacture a manifold structure, comprising:

installing piping in place within a frame construction, the piping comprising a pipe termination having a connector flange positioned laterally exterior of the frame construction and directed upward;

placing a support bracket comprising a horizontal support structure having a central aperture and extending substantially horizontally from a vertical back structure over the pipe termination such that the pipe termination is received through the central aperture and positioned above the plane of the horizontal support structure and coarse adjusting the support bracket relative to the pipe termination;

installing a connector porch with a bottom plate resting atop the horizontal support structure and over the connector flange;

bolting the connector porch to the connector flange; and welding the connector porch to the support bracket and subsequently fine adjusting and fixing the support bracket to the frame construction.

2. The method of claim 1, wherein the coarse adjusting and the fine adjusting comprises operating securing means between a bottom part of the frame the vertical back structure and operating securing means between a top part of the frame and the vertical back structure.

3. The method of claim 1, comprising landing a vertical connector module on the connector porch, the vertical connector module having a pipe bend and connector flange to connect a pipeline.

4. The method of claim 3, wherein the landing the vertical connector module comprises engaging a guiding means of the vertical connector module in a guiding structure located on the vertical back structure and extending upward from the horizontal support structure.

5. A manifold structure, comprising:

a frame having a plurality of pipes each extending laterally outward from the frame to a pipe termination positioned oriented upward;

a support bracket for each of the pipe terminations, each support bracket releasably installed with the frame, the support bracket comprising a vertical back structure releasably connected by securing means to the frame and a horizontal support structure having a central aperture and extending substantially horizontally from the back structure, whereby the pipe extends upward through the central aperture and the pipe termination is positioned above the horizontal support structure and laterally external to the frame; and a guide structure extending along the vertical back structure upward from the horizontal support structure, the guide structure operative with a vertical connector module to land the vertical connector module from above onto the pipe termination.

6. The manifold structure of claim 5, wherein the support bracket is releasably attached to the frame at a lower mount between a bottom part of the frame and the vertical back structure and at an upper mount between a top part of the frame and the vertical back structure.

7. The manifold structure of claim 5, wherein the support bracket is releaseably attached to the frame at a lower mount between a bottom part of the frame and the vertical back structure by the securing means permitting adjustment in positioning the support bracket in the lateral direction relative to the frame and the support bracket is releasably attached to the frame at an upper mount between a top part of the frame and the vertical back structure by the securing means permitting adjustment in positioning the support bracket vertically relative to the frame.

8. The manifold structure of claim 5, wherein the support bracket is a separate unit to be connected by the securing means to the frame after the frame has been located at a seabed.

9. The manifold structure of claim 5, comprising a connector porch landed on each of the horizontal support structures and connected to the associated pipe termination.

10. The manifold structure of claim 5, comprising a connector porch landed on each of the horizontal support structures and connected to the associated pipe termination, wherein the connector porch comprises a bottom plate resting atop the horizontal support structure.

11. A manifold structure, comprising:

a frame having a plurality of pipes each extending laterally outward from the frame to a pipe termination positioned oriented upward;

a support bracket for each of the pipe terminations, each support bracket releasably installed with the frame, the support bracket comprising a vertical back structure releasably connected by securing means to the frame and a horizontal support structure having a central aperture and extending substantially horizontally from the back structure, whereby the pipe extends upward through the central aperture and the pipe termination is positioned above the horizontal support structure and laterally external to the frame;

a connector porch landed on each of the horizontal support structures and connected to the associated pipe termination;

a vertical connector module landed on each of the connector porches, wherein the vertical connector module and the associated connector porch are connected by a clamp connector, wherein the vertical connector module comprises a pipe termination to connect to a pipe line; and a guide structure extending along the vertical back structure upward from the horizontal support structure, the guide structure operative with a guiding means of the vertical connector module to land the vertical connector module on the connector porch.

12. The manifold structure of claim 11, wherein the support bracket is releasably attached to the frame at a lower mount between a bottom part of the frame and the vertical back structure and at an upper mount between a top part of the frame and the vertical back structure.

13. The manifold structure of claim 11, wherein the support bracket is releaseably attached to the frame at a lower mount between a bottom part of the frame and the vertical back structure by the securing means permitting adjustment in positioning the support bracket in the lateral direction relative to the frame and the support bracket is releasably attached to the frame at an upper mount between a top part of the frame and the vertical back structure by the securing means permitting adjustment in positioning the support bracket vertically relative to the frame.

14. The manifold structure of claim 11, wherein the support bracket is a separate unit to be connected by the securing means to the frame after the frame has been located at a seabed.

15. A method to manufacture a manifold structure, comprising:

installing piping in place within a frame construction, the piping comprising a pipe termination having a connector flange positioned laterally exterior of the frame construction and directed upward;

placing a support bracket comprising a horizontal support structure having a central aperture and extending substantially horizontally from a vertical back structure over the pipe termination such that the pipe termination is received through the central aperture and positioned above the plane of the horizontal support structure and coarse adjusting the support bracket relative to the pipe termination;

installing a connector porch atop the horizontal support structure and over the connector flange;

bolting the connector porch to the connector flange;

welding the connector porch to the support bracket and subsequently fine adjusting and fixing the support bracket to the frame construction; and landing a vertical connector module on the connector porch, the vertical connector module having a pipe bend and connector flange to connect a pipeline, wherein the landing comprising engaging a guiding means of the vertical connector module in a guiding structure located on the vertical back structure and extending upward from the horizontal support structure.

16. The method of claim 15, wherein the coarse adjusting and the fine adjusting comprises operating securing means between a bottom part of the frame the vertical back structure and operating securing means between a top part of the frame and the vertical back structure

* * * * *